United States Patent [19]

Suttles

[11] Patent Number: 4,716,841

[45] Date of Patent: Jan. 5, 1988

[54] SHELVING UNIT

[75] Inventor: James M. Suttles, Elberton, Ga.

[73] Assignee: The Mead Corporation, Atlanta, Ga.

[21] Appl. No.: 415,483

[22] Filed: Sep. 7, 1982

[51] Int. Cl.[4] ..... A47B 57/30

[52] U.S. Cl. ..... 108/108; 108/96; 108/152; 211/193; 248/243

[58] Field of Search ..... 108/152, 107, 106, 96, 108/108; 211/190, 193, 208; 248/243, 244, 239; 403/109

[56] References Cited

U.S. PATENT DOCUMENTS

| | | | |
|---|---|---|---|
| 785,196 | 3/1905 | Cannon | 211/190 |
| 1,915,727 | 6/1933 | Friedemann | 248/243 |
| 2,439,049 | 4/1948 | Lesko | 211/190 |
| 2,739,777 | 3/1956 | Schoenhardt | 108/107 |
| 2,971,657 | 2/1961 | Zadek | 108/144 |
| 3,177,988 | 4/1965 | Costantini et al. | 248/243 |
| 3,265,217 | 8/1966 | Biggs | 211/208 |
| 3,523,702 | 8/1970 | Unti et al. | 108/106 |
| 3,983,822 | 10/1976 | Suttles | 248/243 X |
| 4,064,996 | 12/1977 | Shillum | 108/107 X |
| 4,379,430 | 4/1983 | Ruschitzka | 108/107 |
| 4,460,097 | 7/1984 | Darnell, II et al. | 108/108 X |

FOREIGN PATENT DOCUMENTS

| | | | |
|---|---|---|---|
| 2296389 | 7/1976 | France | 211/193 |
| 446646 | 3/1968 | Switzerland | 211/190 |
| 2084450 | 4/1982 | United Kingdom | 211/208 |

*Primary Examiner*—William E. Lyddane
*Assistant Examiner*—Thomas A. Rendos
*Attorney, Agent, or Firm*—Howson and Howson

[57] ABSTRACT

In a sheet metal shelving unit with adjustable telescoping slotted uprights, the upper part of each upright has its slots in a recessed surface so that the upper part does not interfere with shelf bracket tabs projecting rearwardly through slots in the lower part of the upright.

2 Claims, 4 Drawing Figures

SHELVING UNIT

BRIEF SUMMARY OF THE INVENTION

This invention relates to shelving units of the kind used in supermarkets to display soft drinks and various other products. The invention is applicable to a variety of shelving units, and is particularly applicable to a shelving unit of the kind shown and described in my U.S. Pat. No. 3,983,822, issued Oct. 5, 1976. Depending on the use to which they are put, these shelving units are sometimes called "merchandisers".

In U.S. Pat. No. 3,983,822, I describe a sheet metal shelving unit in which identical shelves are held on uprights by the engagement of tabs on shelf brackets with slots in the uprights. Each upright has an upper and lower part. The lower part has a sloping face, while the upper part has a vertical face. The upper part telescopes into the lower part and the two parts are secured together by a suitable fastener. There is no provision for adjusting the height of the upper part relative to the lower part.

In the shelving unit of U.S. Pat. No. 3,983,822, a series of shelf-supporting slots extends substantially the full height of the sloping face of the lower part of each upright. Another series of slots extends substantially the full vertical length of the exposed portion of the upper part. Thus, shelves can be positioned at any desired location on the uprights. The shelving unit described in my patent has the advantage over prior shelving units that it accommodates identical shelves at any desired height, whether on the sloping faces of the lower parts of the uprights or on the vertical faces of the upper parts of the uprights.

When a shelf is positioned on the lower parts of the uprights, the tabs of the shelf brackets extend rearwardly through the slots in the lower parts. In practice, the lower ends of the upper parts, which are hidden within the lower parts, are provided with vertically elongated slots, or are cut-away, to prevent interference between the upper parts and any shelf bracket tabs extending rearwardly through slots at the upper ends of the lower parts.

With the arrangement described in U.S. Pat. No. 3,983,822, it is not possible to slide the upper parts downwardly into the lower parts, and still support shelves at or near the upper ends of the lower parts. This is because the slotted faces of the upper parts would interfere with the shelf bracket tabs extending through the slots in the lower parts. Thus, it has not been possible to make a shelving unit support with adjustable telescoping upper and lower parts without sacrificing an important advantage of the shelving system as described in my patent.

The principal object of the present invention is to provide an adjustable telescoping shelf support which allows identical shelves to be positioned at any desired height on the support. In accordance with the invention, this object is accomplished by forming the slots in the upper support in a rearwardly offset surface. By doing this, a clearance is provided for tabs extending through slots at or near the uppermost end of the lower support.

This invention substantially improves the versatility and space efficiency of merchandising displays by allowing for adjustment to accommodate different sizes of products.

Further objects and advantages of the invention will be apparent from the following detailed description when read in conjunction with the drawings.

DETAILED DESCRIPTION

Figure 1:
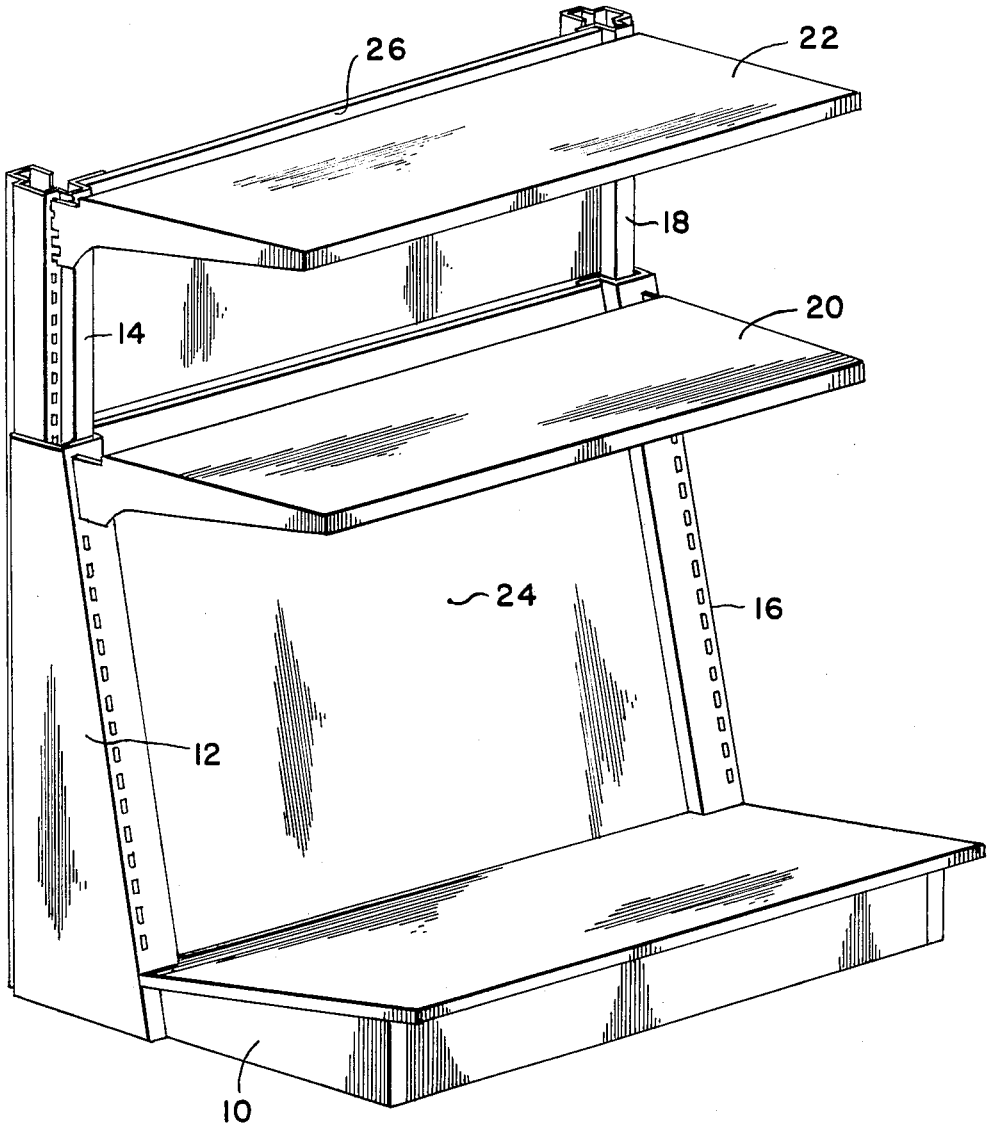
FIG. 1 is an oblique perspective view of a shelving unit in accordance with the invention, having two uprights, each of which comprises a lower part having a sloping slotted face, and an upper part having a vertical slotted face.

The shelving unit of FIG. 1, is preferably constructed from sheet steel. It comprises a base 10, and a pair of uprights secured to and extending upwardly from the opposite ends of the rear edge of the base. The left-hand upright comprises a lower part 12, and an upper part 14 which telescopes into the upper end of part 12. The right-hand upright comprises lower part 16 and upper part 18 which are mirror images respectively of parts 12 and 14. A shelf 20 is supported on the lower parts of the uprights. This shelf has brackets formed along its opposite side edges. The brackets have rearwardly projecting tabs which extend through tab-receiving slots in the faces of parts 12 and 16.

Shelf 22, which is identical to shelf 20, is supported on upper upright parts 14 and 18 by the engagement of the rearwardly projecting tabs on its brackets with slots formed in recessed surfaces on these parts. Preferably, the tabs on the shelf brackets are specially formed for cooperation with the slots, and the slots in the upper parts of the uprights are spaced closer together than the slots in the lower parts of the uprights. Because of the special form of the tabs and the different spacings of the slots, the shelves automatically assume horizontal positions even though the shelves are identical to each other and the slotted surfaces of the upper and lower parts of the uprights are at different angles relative to horizontal. For a more complete understanding of the manner in which shelves are made to assume a horizontal condition automatically, reference should be made to my U.S. Pat. No. 3,983,822, the entire disclosure of which is incorporated here by reference.

A sloping back panel 24 is held between lower upright parts 12 and 16, and a vertical panel 26 is held between upper parts 14 and 18.

In a typical application, soft drink cartons are stacked on the base of the shelving unit, while individual bottles are supported on the shelves. The slope of the base and back panel 24 allows the cartons to be stacked safely to any desired height. If the number of cartons to be displayed is small, several shelves can be supported on the lower upright members and used to hold individual bottles. On the other hand, if a large number of cartons is to be accommodated, shelf 20 can be used in the position shown, or moved up to the upper support members, if necessary.

The fact that the shelves can be moved to any desired position on either support gives the shelving unit a high degree of flexibility in accommodating various types of merchandise. The telescoping feature provided by the present invention gives the shelving unit still greater flexibility, since it enables the height of the upper shelf to be raised when the lower shelf is shifted from the lower parts of the uprights to the upper parts.

Figure 2:
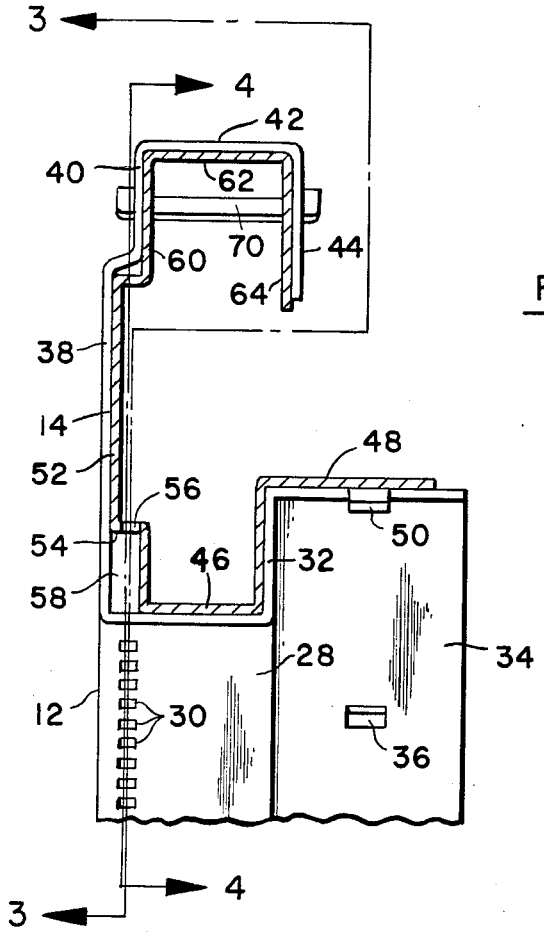
FIG. 2 is a horizontal section through the upper part of the left-hand support of FIG. 1, as viewed from above.

Details of the left-hand upright are seen in FIG. 2.

Lower part 12 has a sloping face 28 with a column of slots 30. A web 32 extends rearwardly from the right-hand edge of face 28, and a flange 34 extends to the right from the rear edge of web 32. Flange 34 has a series of panel-supporting hooks, one of which is shown at 36. These hooks are used to support back panel 24 (FIG. 1). Web 38 extends rearwardly from the left-hand edge of face 28. Web 38 includes an inwardly offset portion 40 at its rear edge. A web 42 extends to the right from the rear edge of offset portion 40, and a flange 44 extends forwardly from the right-hand edge of web 42.

The lower support member just described has an open top which receives upper upright part 14. Part 14 has a cross-sectional shape generally similar to that of lower part 12. It comprises a front face 46, a rearwardly displaced flange 48 having panel supporting hook 50, and a left side web 52 having a face 54 which is offset rearwardly from face 46. Face 54 is provided with a vertical series of slots, one of which is shown at 56. As seen in FIG. 2, both series of slots are spaced the same distance from the plane of web 38 so that slot 56, for example, is directly to the rear of the series of slots 30. Thus the shelf brackets secured to lower part 12 are always directly below the shelf brackets on upper part 14. This is important because the shelves are identical and it is undesirable to have the shelves in anything other than perfect vertical alignment.

The offset relationship between faces 46 and 54 provides a space 58 between faces 28 and 56 to provide clearance for tabs projecting through the upper slots of slot series 30.

The rear part 60 of side web 52 is offset inwardly to conform to part 40 of web 38. A rear web 62 and a forwardly extending flange 64 conform respectively to the inner surfaces of web 42 and flange 44 in order to restrain upper part 14 against rearward and sidewise movement relative to lower part 12.

Upper part 14 of the upright is held against vertical downward movement by a key 70 which extends through elements 40, 60, 64 and 44. Key 70 is a U-shaped sheet metal element which extends through oblique rectangular holes in these four elements and exerts a camming action urging upper part 14 rearwardly so that its web 62 comes into tight engagement with web 42 of lower part 12 as a result of the weight of the upper parts and the shelves and articles it supports. As will be seen, elements 60 and 64 are provided with several oblique openings so that the upper part of the upright can be held by key 70 at any one of several positions on the lower part.

Figure 3:
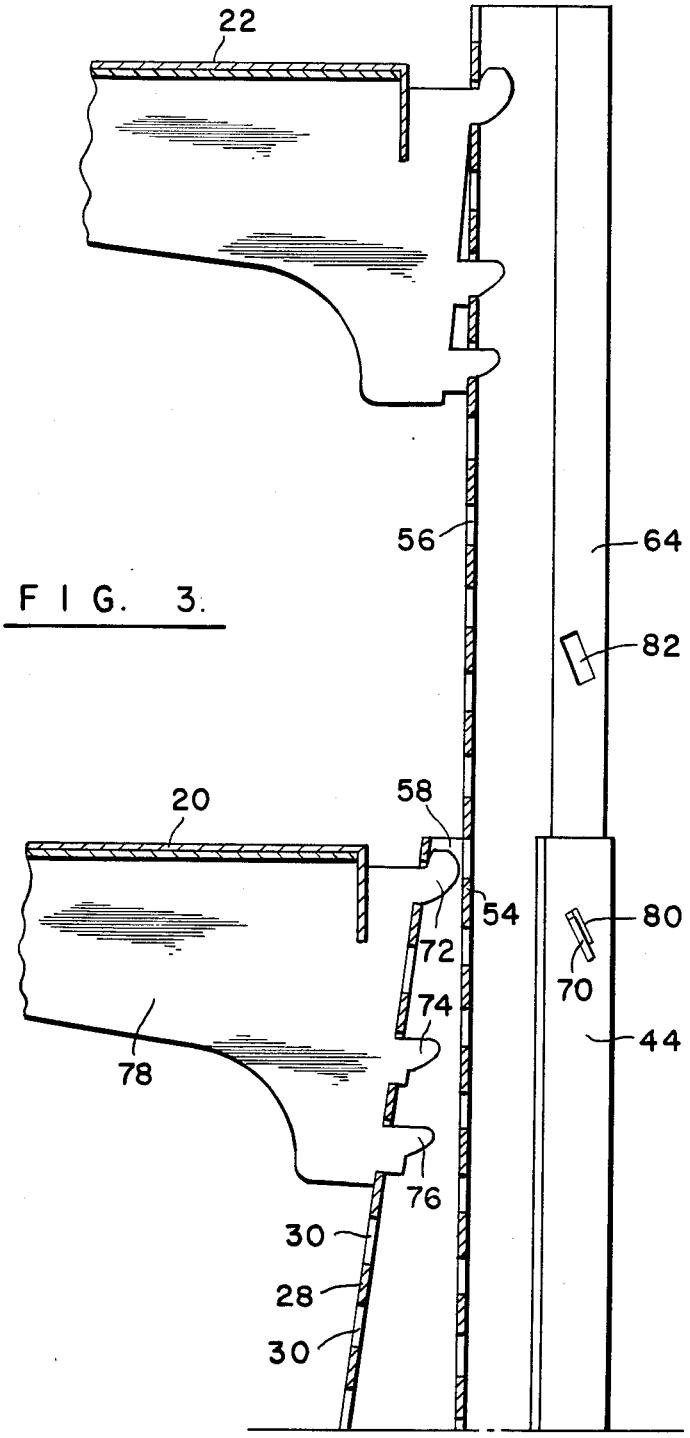
FIG. 3 is a vertical section taken on the surface 3—3 of FIG. 2.
Figure 4:
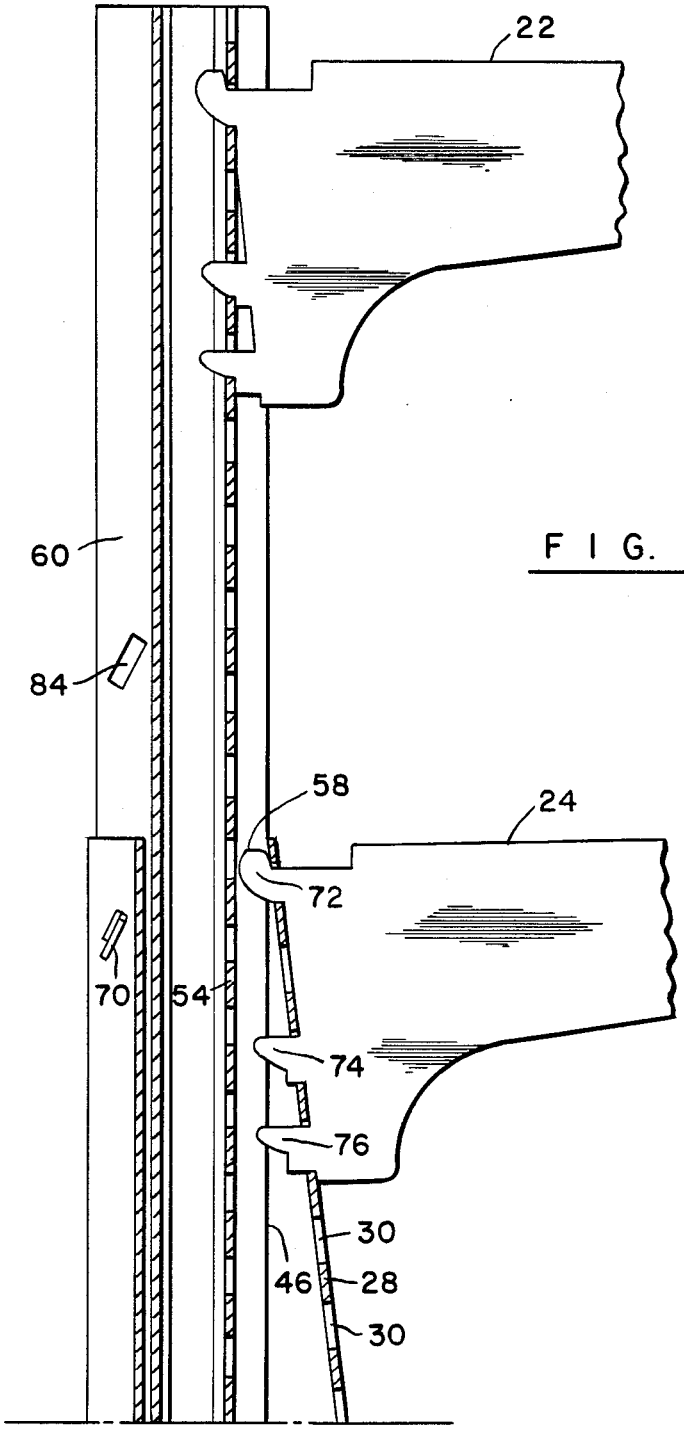
FIG. 4 is a vertical section taken on the plane 4—4 of FIG. 2.

As shown in FIGS. 3 and 4, tabs 72, 74 and 76 on bracket 78 of shelf 20 project rearwardly through slots 30 in sloping face 28 of the lower part of the upright. These tabs extend rearwardly into space 58 beyond face 46 of the upper support member, but do not reach recessed face 54, and therefore do not interfere with the portion of the upper part which extends downwardly into the lower part. The brackets of each shelf extends rearwardly beyond the supporting surfaces of the shelf a sufficient distance so that the tabs can reach and cooperate with the slots of the upper part of the upright, as shown in FIG. 4, without interference between face 46 and the rear edge of the supporting surface.

As shown in FIG. 3, key 70 extends through oblique opening 80 in flange 44, and engages an oblique opening in flange 64. Another oblique opening in flange 64 is shown at 82. A corresponding oblique opening is shown at 84 in FIG. 4.

As will be apparent from the foregoing, the recessed slotted surface of the upper part of the upright enables shelves to be accommodated at any position on the lower part, enables the upper part to be adjusted upwardly or downwardly as desired, and enables shelves to be supported at any desired position on the upper part even when the upper part is fully extended. The invention results in a highly versatile shelving unit suitable for soft drink merchandising and for many other uses. The invention is applicable not only to merchandisers and shelving units of the kind described in U.S. Pat. No. 3,983,822, but also to other merchandisers having two-part telescoping uprights in which the front faces of the lower upright parts are vertical.

Numerous modifications and variations from the shelving unit specifically disclosed herein may be made without departing from the scope of the invention as defined in the following claims.

I claim:

1. A shelving unit comprising a base, at least one upright, and a plurality of shelves mountable thereon:

in which each shelf has at least one bracket with rearwardly extending tabs for engagement with shelf-retaining slots in the upright;

in which the upright comprises a lower vertically elongated member extending upwardly from the base, and an upper vertically elongated member in telescoping relationship with the lower member, at least part of the upper member extending upwardly from the upper end of the lower member, means for preventing relative horizontal movement of the upper and lower members, and means for selectably supporting the upper member in each of a plurality of heights on the lower member;

in which the lower member comprises an elongated, oblique sheet metal web having a face side and a back side and a first series of shelf-retaining slots, each slot extending through the web from the face side to the back side, said first series extending in a line downwardly along said oblique sheet metal web from a location adjacent to the upper end thereof;

in which the upper member comprises an elongated vertical sheet metal web constituting the front side thereof, the web having a face side and a back side the face side having a first planar surface and a second planar surface, the second planar surface being spaced rearwardly and located to one side of the first planar surface, and having a second series of shelf-retaining slots each slot extending from the face side of the second planar surface to the back side of the web, the second series of slots being arranged in a vertical line positioned directly to the rear of the line of said first series of slots; and in which, at least at the upper end of the lower member, the back side of the elongated sheet metal web of the lower member is in such close proximity to the face side of the sheet metal web of the upper member that if one of said shelves is positioned at the uppermost end of the lower member, with a tab extending through the uppermost shelf-retaining slot in the lower member, the tab extends through the plane of said first planar surface, and the spacing between the planes of the first and second planar surfaces being such that said tab does not reach said second planar surface.

2. A shelving unit according to claim 1 in which the shelves are substantially identical to one another, and the tabs of each shelf extend rearwardly a sufficient distance to reach and cooperate with the slots in said second planar surface of the upper member without interference between said first planar surface of the upper member and the shelf.

* * * * *